United States Patent [19]

Alexander et al.

[11] Patent Number: 4,939,863

[45] Date of Patent: Jul. 10, 1990

[54] LASER AIMING DEVICE FOR FIREARMS, ARCHERY BOWS, AND CROSSBOWS

[75] Inventors: James r. Alexander, Scott; Acie G. Johnson, Pine Bluff; Glenn W. Prentice, Little Rock, all of Ark.

[73] Assignee: Emerging Technologies, Inc., Little Rock, Ark.

[21] Appl. No.: 239,133

[22] Filed: Aug. 31, 1988

[51] Int. Cl.[5] ..... F41G 1/34

[52] U.S. Cl. ..... 42/103; 362/110; 362/259; 362/369

[58] Field of Search ..... 42/103, 101; 33/248; 362/110, 114, 259, 369

[56] References Cited

U.S. PATENT DOCUMENTS

| | | | |
|---|---|---|---|
| 2,645,855 | 7/1953 | Ivy | 42/101 |
| 3,040,433 | 6/1962 | Heinzel | 33/248 |
| 4,295,289 | 10/1981 | Snyder | 42/103 |
| 4,313,272 | 2/1982 | Matthews | 42/103 |

*Primary Examiner*—Charles T. Jordan
*Assistant Examiner*—Michael J. Carone
*Attorney, Agent, or Firm*—Hermann Invester, Hill, Van Santen, Steadman & Simpson

[57] ABSTRACT

A laser aiming device having a plasma tube encased by a cylindrical member upon which windage and elevation adjustments act. Resilient ring members separate the cylindrical member from the plasma tube. Another resilient member located between the cylindrical member and an outer housing member cavity wall provides counterforces against which the windage and elevation adjustments act.

13 Claims, 3 Drawing Sheets

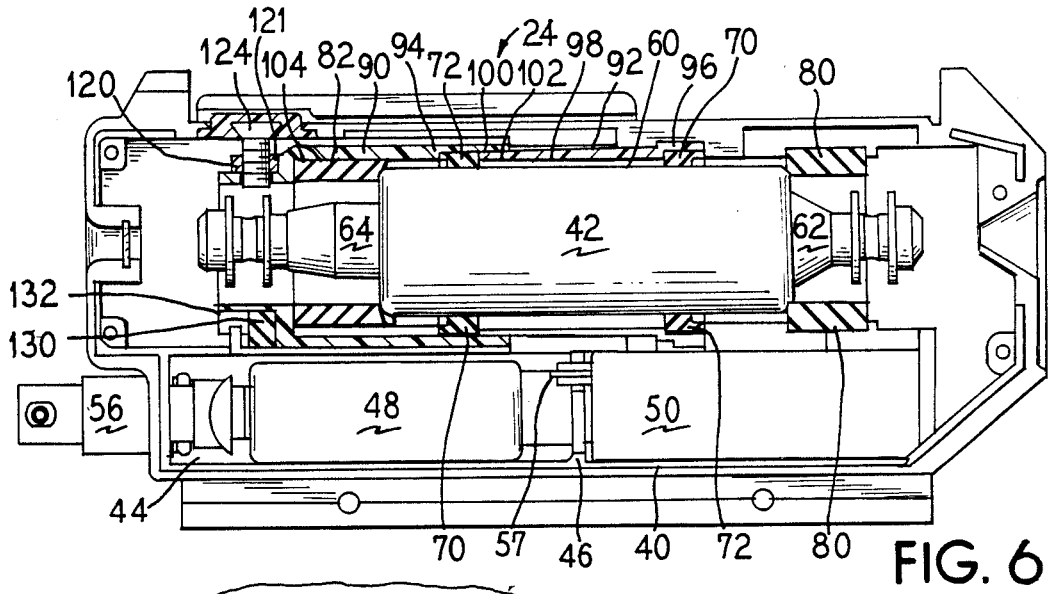
FIG. 6
FIG. 7
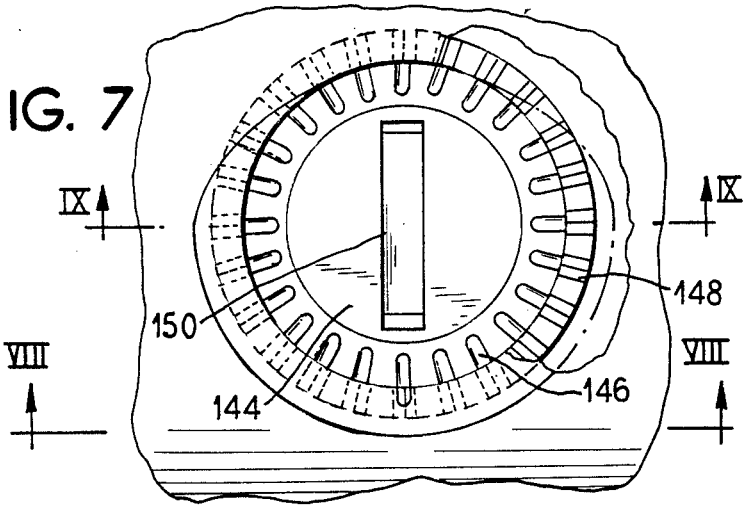
FIG. 8
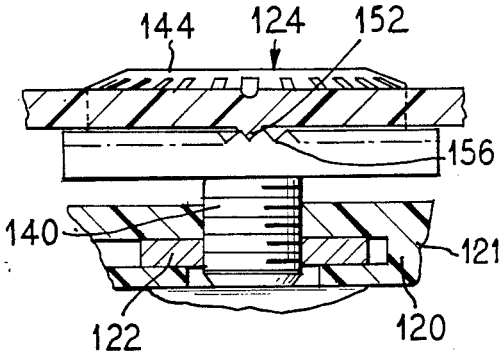
FIG. 9
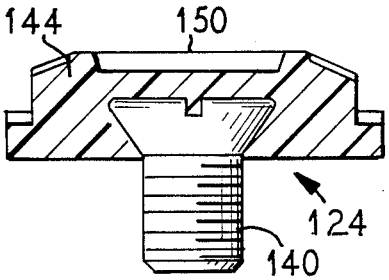

LASER AIMING DEVICE FOR FIREARMS, ARCHERY BOWS, AND CROSSBOWS

BACKGROUND OF THE INVENTION

The present invention relates generally to laser aiming devices and, particularly, to an improved mounting for a laser within a laser aiming device for firearms, archery bows, and crossbows.

Firearm and gun are generic terms for a device that is used to fire a projectile. Usually a firearm or gun consists of a metal tube from which a projectile is fired at high velocity into a flat trajectory. Rifles and pistols are portable types of firearms or guns.

A gunsight is a device used to assist in aiming a gun by guiding an eye of a person firing the gun. It is based on the principle that two points (the eye of the person aiming and a suitable mark on the gunsight) in fixed relation to each can be brought into line with a third point (the target or the desired impact point for the projectile). By aiming the gun, one is able to direct the projectile from the gun at a selected impact point.

Traditionally, a gunsight has been a mechanical device and consists of a small, often beaded, projection (as a blade or post) located on top of the muzzle or discharge end of the gun barrel and a transverse bar or leaf located on top of and near the breach or gunstock end of the gun barrel having a notch or hole that allows alignment with the projection at the muzzle end. The transverse bar or leaf is often adjustable to compensate for changes in range of each trajectory of the projectile or the effect of wind on the projectile. Such adjustments are called adjustments for elevation and windage, respectively.

Other gunsights have included optical devices, so-called scopes, that are formed of lenses which serve to gather visible light and to permit one to view objects at a distance at an enlarged perspective. These scopes generally include crossed lines, the crossing point of which are aligned with the desired impact point of the fired projectile. They may also include an electrically generated "dot" to replace the crossed lines.

More recently, firearms or guns have included small laser aiming devices containing laser plasma tubes that emit a fine laser light beam along the barrel of the firearm or gun and approximately along the trajectory of the projectile. Windage and elevational adjustments realign the longitudinal axis of the plasma tube to cause the laser light beam emitted therefrom to be aimed and shined at different points at which a fired projectile might impact. When adjusted correctly, the laser light beam can be made to shine precisely on the impact point of the projectile. Thus, one using a firearm or gun with a laser aiming device need only point, not aim the gun so that the laser beam shines on the desired impact point to ensure that the projectile hits the impact point. The laser aiming device can be mounted either on top of, below, or beside the barrel of the gun. Moreover, they can be formed with or without gunsights.

The plasma tube of a laser aiming device encloses the ionized gas which produces the laser light beam, upon proper excitation. The plasma tube is mounted within a housing which additionally houses and encases the power source, generally batteries.

Previously there were two basic methods for mounting a plasma tube of a laser in a laser aiming device: a torsion spring system and an O-ring or "doughnut" bushing system. In both systems, the adjustments for windage and elevation are accomplished in the same manner.

In the torsion spring system, a torsion spring is incorporated in a laser gunsight to create the counter forces against which the windage and elevation adjustments act. A single torsion spring is placed at approximately 45 angular degrees between the bottom and the side of a round enclosure wall of a laser housing located about the plasma tube. The plasma tube rests against a bend of the torsion spring. Windage and elevation adjustment screws penetrate the laser aiming device housing along perpendicular paths and act directly against the plasma tube to cause the plasma tube to pivot about a forward pivot/front support located on the end of the plasma tube that does not abut the end of the torsion spring. The forward pivot point/front support is formed by wrapping a ring of tape about a forward end of the plasma tube which also serves to secure the tube within the housing, making it very limited and unreliable.

In the O-ring or doughnut bushing system, an O-ring or doughnut-shaped bushing is placed around the alignment mirrors that are located on the end of the plasma tube. The counter forces for the windage and elevation adjustment screws are provided by the natural elasticity of the ring or bushing. Again, the windage and elevation adjustments are accomplished by screws that penetrate the laser aiming device housing along perpendicular paths and which act directly upon the plasma tube. A strip of material is provided to cushion the impact of the screws on the glass plasma tube, but has proven to be very ineffective, and results in the breaking of many tubes.

In each of the systems described above, since the adjustment screws are in direct contact with the plasma tube and are operatively mounted in the laser aiming device housing, the impact forces upon the firing of the gun are passed directly from the housing through the adjustment screws to the plasma tube. Moreover, in neither of the systems is there provided for a pivot point relative to the windage and elevation adjustments so that the windage and elevation settings are stable or repeatable. Additionally, neither of the systems includes both positive and negative adjustments for windage and elevation.

SUMMARY OF THE INVENTION

In accordance with principles of the invention, a laser aiming device is provided which is durable, stable, and precise. The impact forces upon firing of a gun to which the device is mounted are not transmitted to the plasma tube through the windage and elevation adjustment screws. Moreover, there is provided a pivot point relative to the windage and elevation adjustments so that the adjustment settings are stable and repeatable. Both positive and negative adjustment is provided.

To this end, a laser aiming device is provided that includes a laser plasma tube mounted within a housing having cushioning rings placed about the plasma tube and a cylindrical member encasing the plasma tube and rings. Windage and elevation adjustment screws penetrate the housing and act against the cylindrical member encasing the plasma tube, but not against the plasma tube directly. Counter forces against which the windage and elevation screws act are provided by a resilient cushion inserted between the cylindrical member and the laser housing.

BRIEF DESCRIPTION OF THE DRAWINGS

FIG. 6 is a cross-sectional view of the laser aiming device of FIG. 1 taken along the line VI—VI of FIG. 4;

FIG. 7 is a fragmentary view of a windage or elevation adjustment;

FIG. 8 is a cross-sectional view of the adjustment of FIG. 7 taken along the line VIII—VIII; and FIG. 9 is a cross-sectional view of the adjustment of FIG. 7 taken along the line IX—IX.

DETAILED DESCRIPTION OF THE PRESENTLY PREFERRED EMBODIMENT

In accordance with the invention, a laser aiming device is provided that is durable, stable, and precise for accurately predicting the impact point of a projectile fired from a gun. To this end, elevational and windage adjustment screws provided with the laser gunsight do not act directly on a laser plasma tube contained therein, but instead, act upon a cylindrical member surrounding the plasma tube, thereby eliminating the transmitting of the impact forces from the gun through the adjustment screws to the plasma tube. Furthermore, a pivot point provided for the cylindrical member relative to the windage and elevation adjustments assists in ensuring that the settings are stable and repeatable.

Figure 1:
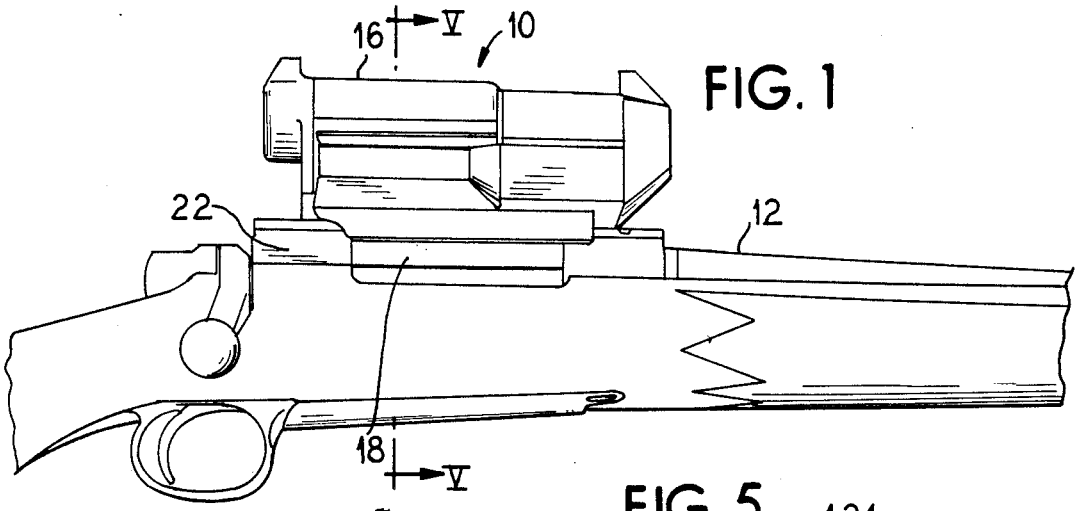
FIG. 1 is a side view of a laser aiming device embodying principles of the invention mounted on top of a rifle barrel.

In FIG. 1 there is illustrated a laser aiming device embodying principles of the invention. The laser aiming device 10 is mounted on top of a barrel 12 of a firearm or rifle 14. As can be seen, the laser aiming device includes a housing member 16 having a mounting member portion 18, illustrated more clearly in FIGS. 2 and 3. The housing member 16 preferably is formed of high impact strength-high stability engineered plastic. Of course, any other suitably durable yet lightweight material can be substituted therefore.

Figure 2:
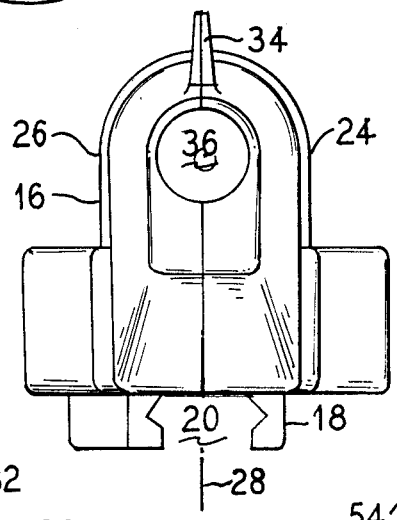
FIG. 2 is a front view of the laser aiming device of FIG. 1.
Figure 3:
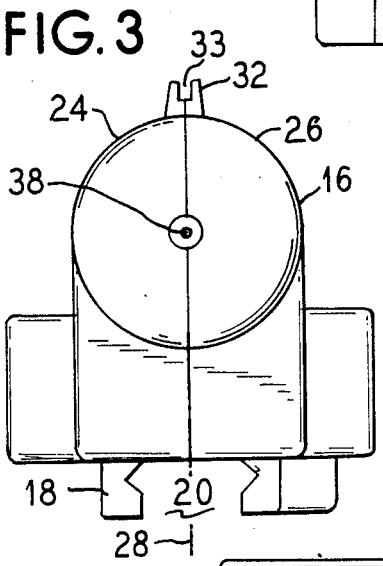
FIG. 3 is a back view of the laser aiming device of FIG. 1.

The mounting portion 18, as is illustrated in FIGS. 2 and 3, is a dovetail mount having a dovetail-shaped channel 20 formed therein. The mounting portion 18 is received on a correspondingly dovetail-shaped receiving member or bar 22 affixed to the top of the barrel 12 of the firearm 14. Other receiving members, not illustrated, can be used to mount the laser aiming device on the underside of a firearm or rifle or on top of a pistol.

Figure 4:
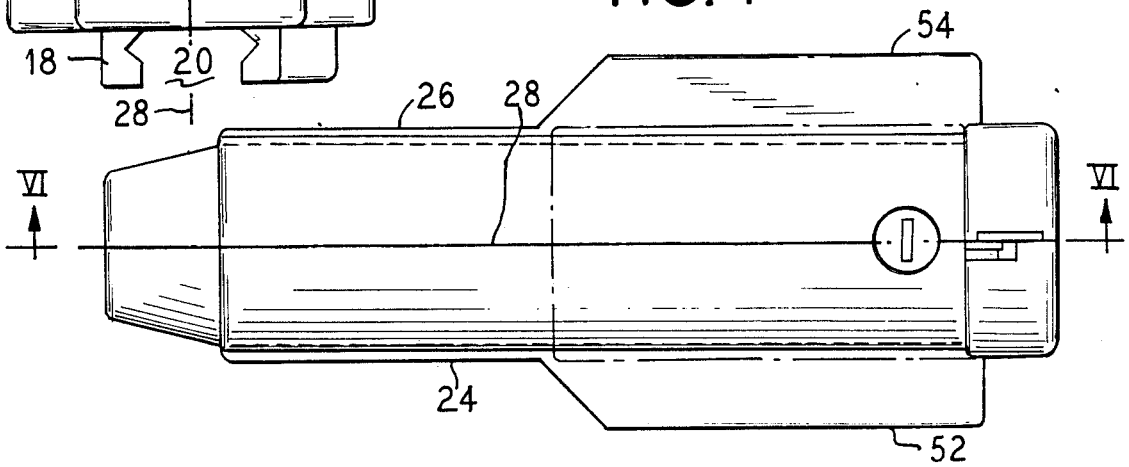
FIG. 4 is a top view of the laser aiming device of FIG. 1.
Figure 10:
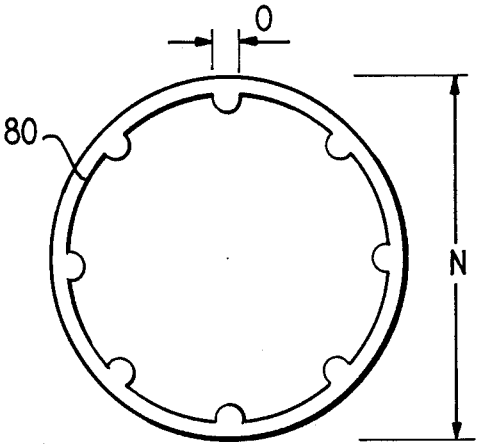
FIG. 10 is an end view of an anchoring end retaining ring used in connection with the present invention.
Figure 11:
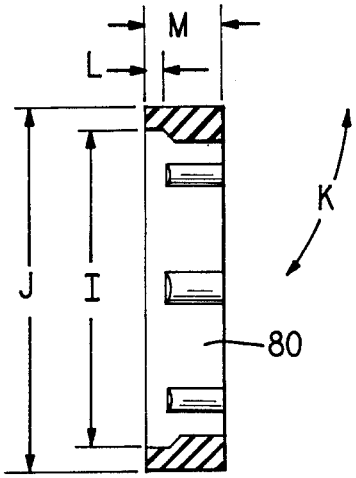
FIG. 11 is a side view of the retaining ring of FIG. 10.

As is illustrated most clearly in FIGS. 2-4, the housing member 16 is formed of two substantially symmetrical halves 24 and 26. Housing member half 24 is also illustrated in FIG. 6. The housing member halves 24 and 26 are secured together by means of cooperating tongues and grooves formed on interior faces thereof which join to form center line 28. The housing member halves 24 and 26 can be further secured together by means of a screw or bolt extending transversely through the housing member 16.

The laser aiming device 10 further includes a traditional gunsight, as is illustrated in FIGS. 1-3. The gunsight is formed of an upstanding blade and the leaf portion 32 which has a notch 33 therein for alignment with the upstanding blade 34. Such a gunsight is included for the convenience of the person firing the gun. If the laser aiming device 10 is mounted below the rifle 14, the gunsight is not needed.

A front lens or aperture 36 through which the laser beam from the laser aiming device 10 is emitted, is illustrated in FIG. 2. A pilot light translucent lens 38 through which the glow of the plasma tube can be seen, is illustrated in FIG. 3. The pilot light lens 38 being located at the gunstock or breach end of the laser aiming device 10, enables one to determine if the laser beam is on by simply looking to see if the pilot light lens 38 is glowing due to the glow of the plasma tube within the laser device 10.

Figure 5:
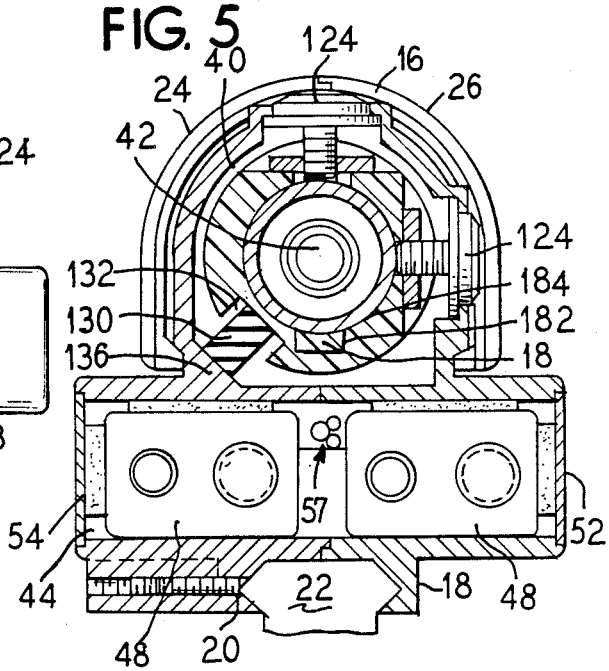
FIG. 5 is a cross-sectional view of the laser aiming device of FIG. 1 taken along the line V—V.

When the housing member halves 24 and 26 are secured together, as illustrated in FIGS. 2-4, they form several cavities as illustrated more clearly in FIGS. 5 and 6. The largest cavity, cavity 40, is adapted for receiving and mounting a laser plasma tube 42. Remaining cavities 44 and 46, are adapted to receive batteries 48 and capacitor 50, respectively. The cavity 44 is large enough to hold two 9-volt batteries 48, walls 52 and 54 of the housing member 16 protruding in a square shape to accommodate the correspondingly shaped batteries 48. The cavity 46, in addition to receiving the capacitor 50, accommodates a portion of a bayonet switch 56 which extends through the breach or gunstock end of the housing member 16. The bayonet switch 56 is used to turn the laser plasma tube 42 on and off. Wires 57, illustrated in FIGS. 5 and 6, couple the batteries 48 and the capacitor 50 to the bayonet switch 56 in the known manner.

In FIGS. 5 and 6, the inside of the housing member half 24 is illustrated showing the mounting of the plasma tube 42 of the laser aiming device 10. The left hand side of the plasma tube 42, as illustrated in FIG. 6, is referred to hereinafter as the adjusting end. The right hand side of the plasma tube is referred to hereinafter as the anchor end. The adjusting end is located nearest the breach or gunstock of the firearm 14 while the anchor end is located nearest the muzzle end of the firearm 14.

The plasma tube 42 illustrated in FIGS. 5 and 6, is cylindrically shaped and includes a central portion 60, an anchoring end portion 62 and an adjusting end portion 64. As illustrated, the central portion 60 has a much larger diameter than either of the anchoring or adjusting end portions 62 and 64, respectively.

Two recoil shock rings 70 and 72, formed of a resilient material, such as silicone rubber, are placed around the central portion 60 of the plasma tube 36. The anchoring end recoil shock ring 70 is placed near the anchoring end of the central portion 60 while the adjusting end recoil shock ring 72 is placed nearer to the adjusting end. The recoil shock rings 70 and 72 serve to cushion the plasma tube from the shock forces generated upon the discharging of the gun 14, and otherwise to isolate the plasma tube 42 across the housing 16. It is conceivable, of course, to utilize a single recoil shock ring that covers a large portion of the central portion 60. However, it is believed that utilizing two recoil shock rings uses less material and therefore, is more cost effective.

Figure 12:
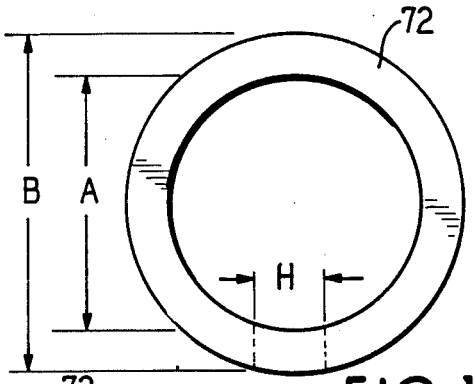
FIG. 12 is an end view of an adjusting end recoil shock ring used in connection with the present invention.
Figure 15:
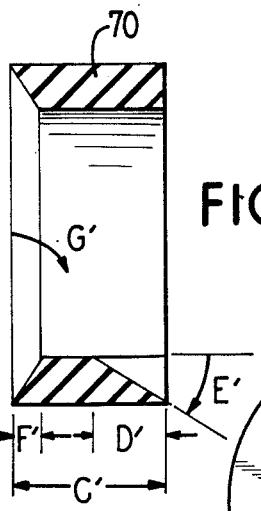
FIG. 15 is a side view of the recoil shock ring of FIG. 14.
Figure 14:
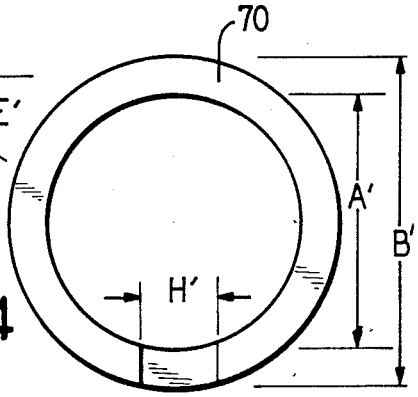
FIG. 14 is an end view of an anchoring end recoil shock ring used in connection with the present invention.
Figure 13:
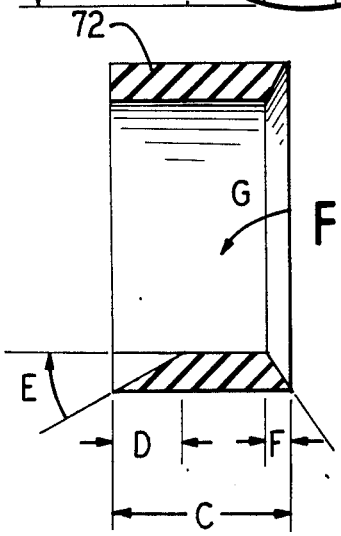
FIG. 13 is a side view of the recoil shock ring of FIG. 12.

The rings 70 and 72 are illustrated in greater detail in FIGS. 12 through 15. FIGS. 12 and 13 illustrate the adjusting end recoil shock ring 72 in detail while FIGS. 14 and 15 illustrate the anchoring end recoil shock ring 70 in detail. Although the recoil shock rings 70 and 72 are very similar in shape, certain dimensions are different.

It can be appreciated that in accordance with principles of the invention, in the design of the presently preferred embodiment, the laser aiming device 10 is adapted to receive any of several different plasma tubes manufactured by several different manufacturers. Although the plasma tubes are very similar, there are variations in dimensions of the various portions of the different plasma tubes. Therefore, the dimensions of the rings 70 and 72 used vary according to the plasma tube 42 used.

In FIGS. 12 through 15, various dimensions are designated by letters A through H and A' through H', the preferred measurements of which are set forth in Tables I and II below. Table I corresponds to FIGS. 12 and 13 and Table II corresponds to FIGS. 14 and 15.

TABLE I

| PLASMA TUBE MANUFACTURER: | | X | Y | Z |
|---|---|---|---|---|
| LENGTH OF PLASMA TUBE: | | | 2.716 in. | 3.290 in. |
| DIMENSION— | TOLERANCE | | | |
| A | +/−.010 | .86 in. | .82 in. | .77 in. |
| B | +/−.005 | | .57 in. | .140 |
| C | +/−.020 | | .21 in. | 0 |
| D | +/−5 | | 30° | 0 |
| E | +/−.005 | | 0 in. | .075 |

TABLE I-continued

| PLASMA TUBE MANUFACTURER: | | X | Y | Z |
|---|---|---|---|---|
| LENGTH OF PLASMA TUBE: | | | 2.716 in. | 3.290 in. |
| DIMENSION | TOLERANCE | | | |
| F | +/−5 | | 0° | 30° |
| G | +/−.020 | | .36 in. | 0 |

Presently Preferred Dimensions For An Adjusting End Recoil Shock Ring Illustrated In FIGS. 12 And 13.

TABLE II

| PLASMA TUBE MANUFACTURER: | | X | Y | Z |
|---|---|---|---|---|
| LENGTH OF PLASMA TUBE: | | | 2.716 in. | 3.290 in. |
| DIMENSION | TOLERANCE | | | |
| A' | +/−.010 | .86 in. | .82 in. | .77 in. |
| B' | +/−.005 | | .50 in. | .450 in. |
| C' | +/−.020 | | 0 in. | .36 in. |
| D' | +/−5 | | 0° | 30° |
| E' | +/−.005 | | 0 in. | .090 in. |
| F' | +/−5 | | 0° | 30° |
| G' | +/−.020 | | 0 in. | .25 in. |

Presently Preferred Dimensions For An Anchoring End Recoil Shock Ring Illustrated In FIGS. 14 And 15.

Additionally, at each end of the central portion 60 of the plasma tube 42 is placed a retaining ring 80 or 82. The retaining rings 80 and 82 are called, accordingly, the anchoring end retaining ring 80 and the adjusting end retaining ring 82. The retaining rings 80 and 82 are also formed of a resilient material such as silicone rubber.

The retaining rings 80 and 82 are illustrated in detail in FIGS. 10–11 and 16–17, respectively. As with the recoil shock rings 70 and 72, the retaining rings 80 and 82 are dimensioned according to the particular plasma tube 42 utilized. In FIGS. 10–11 and 16–17, there are included various designations I through O and I' through O' corresponding to dimensions that vary according to the particular plasma tube 42 utilized. The corresponding dimensions that are presently preferred are set forth in the tables below. Table III corresponds to FIGS. 10–11, while Table IV corresponds to FIGS. 16–17.

TABLE III

| PLASMA TUBE MANUFACTURER AND MODEL NUMBER | TUBE DIAMETER | DIMENSION "I" | DIMENSION "J" |
|---|---|---|---|
| X | .944 to 1.023 in. | .964 in. | 1.050 in. |
| Y | .905 to .984 in. | .895 in. | .980 in. |
| Z | .845 to .924 in. | .825 in. | .930 in. |
| Dimensions K–O may not vary for the differently manufactured plasma tubes. Dimensions K–O are as follows: | | | |
| K | 45° | | |
| L | .060 in. | | |
| M | .285 to .290 in. | | |
| N | 1.160 to 1.170 in. | | |
| O | .09 in. | | |
| Presently Preferred Dimensions For An Anchoring End Ring Illustrated In FIGS. 10 And 11. | | | |

TABLE IV

| PLASMA TUBE MANUFACTURER AND MODEL NO. | TUBE DIAMETER | DIMENSION "I'" | DIMENSION "J'" |
|---|---|---|---|
| X | .944 to 1.023 in. | .964 in. | 1.050 in. |
| Y | .905 to .984 in. | .895 in. | .980 in. |
| Z | .845 to .924 in. | .825 in. | .930 in. |
| Dimensions K'–O' do not vary for the differently manufactured plasma tubes. Dimensions K'–O' are as follows: | | | |
| K' | 45° | | |

TABLE IV-continued

| | |
|---|---|
| L' | .060 in. |
| M' | .230 to .250 in. |
| N' | 1.110 to 1.20 in. |
| O' | .09 in. |

Figure 17:
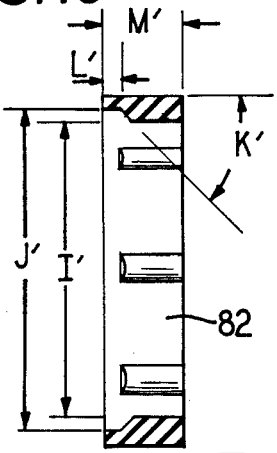
FIG. 17 is a side view of the retaining ring of FIG. 16.
Figure 16:
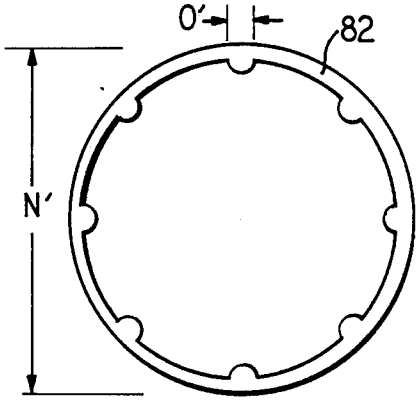
FIG. 16 is an end view of an adjusting end retaining ring used in connection with the present invention.

Presently Preferred Dimensions For An Adjusting End Retaining Ring Illustrated In FIGS. 16 And 17.

It can be appreciated that due to the shape of the retaining rings 80 and 82, the diameter A being less than the diameter B, the rings 80 and 82 fit around the corners of the ends of the central portion 60. Further, plasma tube 42 is able to pivot within the anchoring end retaining ring 80 as the corners of the anchoring end of the central portion 80 are rounded. Thus, the retaining ring also serves as a forward pivot point for the plasma tube 42.

It can be further appreciated, as illustrated in FIG. 6, that the recoil shock rings 70 and 72 and the retaining rings 80 and 82 are the only elements that contact the glass plasma tube 42, thereby isolating the plasma tube 42 from the housing 16. The plasma tube 42 and rings 70, 80, and 82 are surrounded by cylindrical member 90. The retaining ring 72 is located outside of the cylindrical member 90. The cylindrical member 90 in turn is mounted within the housing 16.

As illustrated in FIG. 6, The cylindrical member 90 includes two portions, forward sleeve portion 92 and rear sleeve portion 94. The forward sleeve portion 92 is adapted to receive recoil shock rings 70 and 72. To this end, the forward sleeve portion 92 includes a receiving portion 96 at the forward end thereof that has an enlarged diameter so that the recoil shock ring 70 fits within the forward end of the forward sleeve portion 92. Furthermore, the remaining portion 98 of the forward sleeve portion 92 is formed so as to have a slight taper of ¾° and fits around the recoil shock ring 72.

The remaining portion 98 of the forward sleeve portion 92 is tapered so as to fit within receiving portion 100 of the rear sleeve portion 94. The receiving portion 100 of the rear sleeve portion 94 is formed of a enlarged diameter recessed within the sleeve portion 94. This recess 100 is not tapered but fits over the rear end 102 of the tapered portion of the forward sleeve portion 92. The two sleeve portions 92 and 94 are secured together by means of glue, epoxy, or the like.

The rear sleeve portion 94 further includes a recess 104 of a lesser diameter than the recess 100 in which is accommodated and received the adjusting end retaining ring 82.

As further illustrated in FIG. 6, the rear sleeve portion 94 is adapted to receive windage and elevation adjusting screws 124 and to operatively cooperate therewith to realign the longitudinal axis of the plasma tube 42. The this end, nut receiving portions 120, only one of which is illustrated in FIGS. 6 and 8, are formed on the rear end 121 of the rear sleeve portion 94. Each of the nut receiving portions 120 includes a pocket for receiving a nut 122 and is adapted to receive an adjusting screw such as the elevational adjusting screw 124 therethrough. The windage and elevational adjusting screws are operatively associated with the housing 16 so as to engage both the housing 16 and the nut 122 and to cause relative positive and negative movement of the rear sleeve portion 94, and therefore the cylindrical member 90, to the housing 16.

Illustrated in FIGS. 5 and 6, is a resilient member 130 made of a resilient material such as urethane rubber that is received by the rear sleeve portion 94. The resilient member 130 fits within a milled groove 132 formed within the rear sleeve portion 94 as most clearly illustrated in FIG. 5. The resilient member 130 provides the counterforces against which the windage and elevation screws act. Because the resilient member 130 provides the counterforces for both the windage and elevation adjustment screws, it is placed at a 45° angle relative to both of the screws and accordingly, the milled groove 132 is also positioned at a 45° angle relative to these screws. The housing 16 includes an angled floor portion 136 adapted to receive thereon the resilient member 130 and to position same at the required 45° angle.

The windage or elevation adjustment screws 124 are illustrated in more detail in FIGS. 7, 8 and 9. As can be appreciated, each adjustment includes a screw 140, the head of which is captured within a cap 144. The cap 144 has radially extending indications 146 that align with similar indications 148 located on a ring on the housing 16. Each cap 144 further includes a slot 150 into which can be inserted an instrument such as a screwdriver to turn the screw either clockwise or counterclockwise.

As illustrated in FIG. 8, the cap 144 includes a projection 152 that engages sawteeth 156 formed in a ring on the housing 16. The projection 152 provides a detent so that the windage or elevational adjustment is provided with adjustments in incremental steps.

As is further illustrated, the screw 140 of each of the windage or elevational adjustments 124 extends through the nut retaining portion 120 of the adjustment end portion 121 of the cylindrical member 90 and the nut located 122 therein. As can be appreciated, clockwise turning of each adjustment 124, providing the screw 140 is a right handed screw, will cause the cylindrical member 90 to pivot in a direction towards the outside of the housing 16. In contrast, counterclockwise rotation of the screw 140 will cause the cylindrical member 90 to pivot away from the outside of the housing 16.

It can be further appreciated that pivoting of the cylindrical member 90 necessarily causes pivoting of the plasma tube 42 as the plasma tube 42 is secured within the cylindrical member 90. Thus, rotation of the adjustment screws 122 causes a realignment of the plasma tube 42 and therefore the laser beam emitted therefrom.

Additionally, as illustrated, the adjustment screws 122 do not act directly upon the plasma tube 42. Instead, the plasma tube 42 is insulated from any recoil shock waves that would ordinarily be transmitted through the adjustment screws 122. Therefore, firing of the firearm 12 will not cause the transmission of shock waves to the plasma tube 42 to thereby cause misalignment thereof.

Finally, in FIGS. 5 and 6, sections of anode wires 180 are illustrated that couple the glass plasma tube 42 to the bayonet switch 56. The rear sleeve portion 94 of the cylindrical member 90 includes a passageway or recess 182 formed on an interior surface 184 to accommodate passage of the wires from the glass plasma tube 42 to the switch 56.

While a preferred embodiment has been shown, modifications and changes may become apparent to those skilled in the art which shall fall within the spirit and scope of the invention. It is intended that such modifications and changes be covered by the attached claims.

We claim:

1. A laser aiming device for firearms comprising:
a housing member having a cavity adapted to receive a laser plasma tube;
a laser plasma tube positioned within said cavity;
a cylindrical member positioned within said cavity so as to surround said plasma tube about a longitudinal axis; and
resilient means separating said cylindrical member and said plasma tube to cushion the plasma tube from shock forces generated by the firearm with which it is utilized;
wherein said cylindrical member includes interconnecting cylindrical sleeve portions, one of which can be partially inserted into one end of the other.

2. A laser aiming device as set forth in claim 1, wherein said resilient means comprising at least two longitudinally spaced rings separating said cylindrical member and said plasma tube at a central portion of said plasma tube.

3. A laser aiming device as set forth in claim 1, further including resilient plasma tube support members positioned at opposite ends of said plasma tube and in contact therewith to support said plasma tube and separate said plasma tube from walls of said cavity.

4. A laser aiming device for firearms comprising:
a housing member having a cavity adapted to receive a laser plasma tube;
a laser plasma tube positioned within said cavity;
a cylindrical member positioned within said cavity so as to surround said plasma tube about a longitudinal axis; and
resilient means separating said cylindrical member and said plasma tube to cushion the plasma tube from shock forces generated by the firearm with which it is utilized;
further including resilient plasma tube support means positioned at opposite ends of said plasma tube and in contact therewith to support said plasma tube and separate said plasma tube from walls of said cavity; further including means for adjusting the axis of the plasma tube relative to the housing member, said means operatively engaging said housing member and one end of said cylindrical member, said cylindrical member pivoting about its other end.

5. A laser aiming device, comprising:
a housing member having a cavity adapted to receive a laser plasma tube;
a laser plasma tube positioned within said cavity;
a cylindrical member positioned within said cavity so as to surround said plasma tube about a longitudinal axis thereof;
a number of resilient rings positioned about a central portion of said plasma tube and separating said cylindrical member and said plasma tube with a cushioned support;
a pair of resilient ring members positioned at opposite ends of said plasma tube supporting said plasma tube within said cavity;
a number of adjusting screws operatively engaged with said housing member and one end of said cylindrical member, rotation of said screws causing said cylindrical member to pivot about its other end and, consequently, causing said longitudinal axis of said plasma tube to be realigned; and
a resilient member positioned between said cylindrical member and a wall of said cavity, said resilient member providing counterforces against which said adjusting screws act.

6. A laser aiming device as set forth in claim 5, wherein said cylindrical member comprises two sections operatively engaged to each other.

7. A laser aiming device, comprising:
a housing member having a cavity adapted to receive a laser plasma tube;
a laser plasma tube positioned within said cavity;
a cylindrical member positioned within said cavity so as to surround said plasma tube about a longitudinal axis thereof, said cylindrical member comprising two sections operatively engaged to each other, one of said sections of said cylindrical member including a tubular tapered portion and said other of said sections including a non-tapered tubular portion adapted to receive said tubular tapered portion;
a number of resilient rings positioned about a central portion of said plasma tube and separating aid cylindrical member and said plasma tube with a cushion support;
a pair of resilient ring members positioned at opposite ends of said plasma tube supporting said plasma tube within said cavity;
a number of adjusting screws operatively engaged with said housing and one end of said cylindrical member, rotation of said screws causing said cylindrical member to pivot about its other end, and consequently, causing said longitudinal axis of said plasma tube to be realigned, and
a resilient member positioned between said cylindrical member and a wall of said cavity, said resilient member providing counter forces against which said adjusting screws act.

8. A laser aiming device, comprising:
a housing member having a cavity adapted to receive a laser plasma tube;
a cylindrical member positioned within said cavity;
a laser plasma tube positioned within said cylindrical member;
at least one means for separating said plasma tube from interior walls of said cylindrical member positioned between said interior walls of said cylindrical member and said plasma tube;
at least one means for adjusting the alignment of the longitudinal axis of said plasma tube operatively engaging said housing member and one end of said cylindrical member, said cylindrical member pivoting about its opposite end.

9. A laser aiming device as set forth in claim 8, further including means for providing counterforces against which each of said means for adjusting acts positioned between said cylindrical member and a wall of said cavity, said means being positioned between said cylindrical member and interior walls of said cavity.

10. A laser aiming device as set forth in claim 9, wherein said means for providing counterforces includes a resilient member positioned at a 45° angle between two means for adjusting the alignment of the longitudinal axis of said plasma tube.

11. A laser device as set forth in claim 8, wherein said means for separating said plasma tube from said cylindrical member comprises a resilient ring member positioned about said plasma tube.

12. A laser aiming device as set forth in claim 8, wherein said cylindrical member comprises two sections operatively engaged to each other.

13. A laser aiming device, comprising:

a housing member having a cavity adapted to receive a laser plasma tube;

a cylindrical member positioned within said cavity;

a laser plasma tube positioned within said cylindrical member;

at least one means for separating said plasma tube from interior walls of said cylindrical member positioned within said interior walls of said cylindrical member and said plasma tube; and at least one means for adjusting the alignment of the longitudinal axis of said plasma tube operatively engaging said housing member and one end of said cylindrical member, said cylindrical member pivoting about its opposite end, said means for adjusting the alignment of the longitudinal axis of said plasma tube comprising a screw extending through a portion of the housing member and threadingly engaging a nut operatively located in the end of the cylindrical member.

* * * * *